United States Patent [19]

Landwehrkamp et al.

[11] Patent Number: 4,773,210

[45] Date of Patent: Sep. 27, 1988

[54] OPEN-END ROTOR-SPINNING DEVICE

[75] Inventors: Hans Landwehrkamp, Lenting; Eberhard Grimm, Ingolstadt; Eugen Hini, Lenting; Kurt Inderst, Ingolstadt, all of Fed. Rep. of Germany

[73] Assignee: Schubert & Salzer, Ingolstadt, Fed. Rep. of Germany

[21] Appl. No.: 684,848

[22] Filed: Dec. 21, 1984

[30] Foreign Application Priority Data

Dec. 23, 1983 [DE] Fed. Rep. of Germany ..... 3346843

[51] Int. Cl.[4] ..... D01H 1/243; F16C 19/14; F16D 51/00

[52] U.S. Cl. ..... 57/406; 57/88; 57/92; 384/446; 384/473; 384/611; 384/615; 384/616; 188/75

[58] Field of Search ..... 57/92, 102, 104, 103, 57/406, 407, 88; 384/228, 513, 231, 514, 240, 230, 241, 516, 243, 244, 473, 420, 446, 463, 462, 609, 606, 611, 519, 615, 583, 548, 616; 188/75, 67

[56] References Cited

U.S. PATENT DOCUMENTS

| | | | |
|---|---|---|---|
| 1,338,904 | 5/1920 | Chapman | 384/606 X |
| 1,763,840 | 6/1930 | Watling | 384/616 |
| 2,173,561 | 9/1939 | Olson | 384/519 X |

FOREIGN PATENT DOCUMENTS

| | | | |
|---|---|---|---|
| 1134866 | 8/1962 | Fed. Rep. of Germany | 384/616 |
| 652714 | 5/1951 | United Kingdom | 384/240 |

*Primary Examiner*—David Werner
*Attorney, Agent, or Firm*—Dority & Manning

[57] ABSTRACT

The invention relates to an open-end rotor-spinning device with a rotor shaft which is mounted and driven in the wedge-shaped gap between supporting disks and to the free end of which is assigned an axial bearing. A simplified mounting, which also allows the supporting disks to be removed and exchanged while the machine is in operation, is provided because the rotor shaft (1) is mounted at two bearing points, of which one is formed by supporting disks (2, 3) arranged in the vicinity of the spinning rotor (10) and the second is a bearing (5) which absorbs axial and radial forces and which receives the free end (11) of the rotor shaft (1). An increase in the operating speed of the spinning rotor (10) without an increase in the running speed of the drive means (6) is achieved as a result of a reduction of the diameter of the rotor shaft (1) in the region of the drive means.

29 Claims, 4 Drawing Sheets

OPEN-END ROTOR-SPINNING DEVICE

The invention relates to an open-end rotor-spinning device with a rotor shaft which is mounted in the wedge-shaped gap between supporting disks and to the free end of which is assigned an axial bearing.

It is known to mount the shaft of an open-end spinning rotor radially in the wedge-shaoed gap between each of two pairs of supporting disks arranged at a distance from one another and, for the purpose of securing it axially in position, to press its free end against a step bearing, for example against a disk or a ball, by means of an axial force imparted to the shaft (German Patent Specification No. 2,061,462 and German Patent Specification No. 2,514,734). The axles of the two pairs of supporting disks are mounted so as to be freely rotatable in a bearing housing which is fixed to a baseplate integral with the machine. The rotor shaft is driven directly by means of a tangential belt running between the pairs of supporting disks, but it can also be driven indirectly via the supporting disks or a pressure roller located between the two pairs of supporting disks (German Offenlegungsschrift No. 1,901,453).

This mounting makes it possible to operate the spinning device at high speeds of rotation and allows the spinning rotor to be exchanged quickly, since its shaft can without difficulty be drawn out of the bearing and introduced into the latter again. However, a disadvantage is that the bearing is expensive, and dismantling and installation of the supporting-disk mounting, for example to exchange supporting disks with a worn contact coating, during operation is prevented by the drive means. In this case, the machine has to be stopped, as a result of which its output is reduced.

These disadvantages are also present in another known device, wherein a ball bearing, in which the free shaft end of reduced diameter is mounted, is used as an axial bearing for a rotor shaft mounted radially in the wedge-shaped gap between each of two pairs of supporting disks (German Offenlegungsschrift No. 2,305,189).

The object of the present invention is to provide a simplified mounting for the rotor shaft, which also makes it possible to remove and exchange the supporting disks while the machine is in operation. A further object is to increase the operating speed of the spinning rotor without increasing the running speed of the drive means.

According to the invention, the first-mentioned object is achieved in that the rotor shaft is mounted at two bearing points, of which one bearing point is formed by supoorting disks arranged in the vicinity of the spinning rotor and the second bearing point is a bearing which absorbs axial and radial forces and which receives the free end of the rotor shaft.

In an advantageous development of the subject of the invention, the free end of the rotor shaft is of reduced diameter. Appropriately, the bearing at the end of the rotor shaft is a roller bearing which absorbs axial forces in the direction going away from the spinning rotor, but which releases the end of the rotor shaft in the direction of the spinning rotor. In a further embodiment, the bearing at the end of the rotor shaft is a plain bearing. To secure the axial position of the spinning rotor during running, an axial thrust is generated by offsetting the axles of the supporting disks. Alternatively, the axial force securing the spinning rotor in an axial position is generated by a magnet acting on the end of the rotor shaft.

Exact axial positioning ot the spinning rotor becomes possible because the bearing receiving the end of the rotor shaft is axially adjustable. This is achieved in a simple way by arranging the bearing at the end of the rotor shaft in an adjustable bearing bush. To maintain the bearing free of vibration, the bearing is ounted elastically in the bearing bush. Because a centering bore through which the rotor shaft is guided is located in front of the bearing at the end of the rotor shaft, damage to the bearing when the rotor shaft is pushed in and the escape of lubricants from the bearing are prevented.

Sagging of the rotor shaft caused by the drive means is prevented, even when the shaft diameter is relatively small, by locating the drive means in the vicinity of the supporting disks. The rotor shaft is preferably driven directly by means of a tangential belt. However, the rotor shaft can also be driven by a friction roller, in which case, for example, a tangential belt or an electric motor serves as a drive means for the friction roller. To stop the rotor shaft quickly, a braking device is arranged between the drive means and the bearing at the end of the rotor shaft. Only a slight load on the bearing is ensured in that the braking device contains two pivoting arms arranged on both sides of the rotor shaft and provided with brake jaws.

The object of increasing the operating speed of the spinning rotor without increasing the running speed of the drive means is achieved in that the diameter of the rotor shaft in the region of the drive means is reduced.

Exemplary embodiments of the invention are described in more detail below with reference to the drawings, in which.

Figure 1:
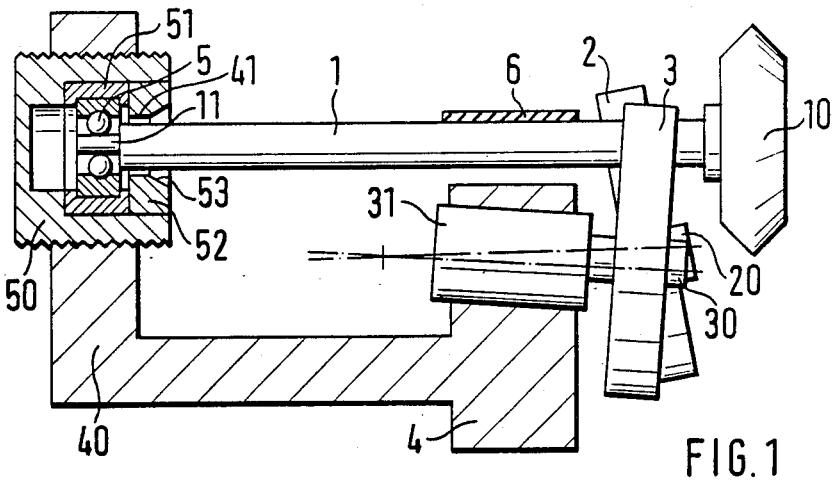
FIG. 1 shows, in a side view and partially in section, a first embodiment of the rotor mounting designed according to the invention, with a pair of supporting disks and a roller bearing receiving the shaft end.

In the Figures, 1 denotes a rotor shaft which carries a spinning rotor 10 at one of its ends. In the vicinity of the spinning rotor 10, the rotor shaft 1 is mounted in the wedge-shaped gap between two supporting disks 2 and 3, the axles 20 and 30 of which are each mounted so as to be freely rotatable in a bearing housing 21 and 31. The bearing housings 21 and 31 are inserted releasably in a bearing block 4 integral with the machine, for example by means of a clamping closure.

Figure 2:
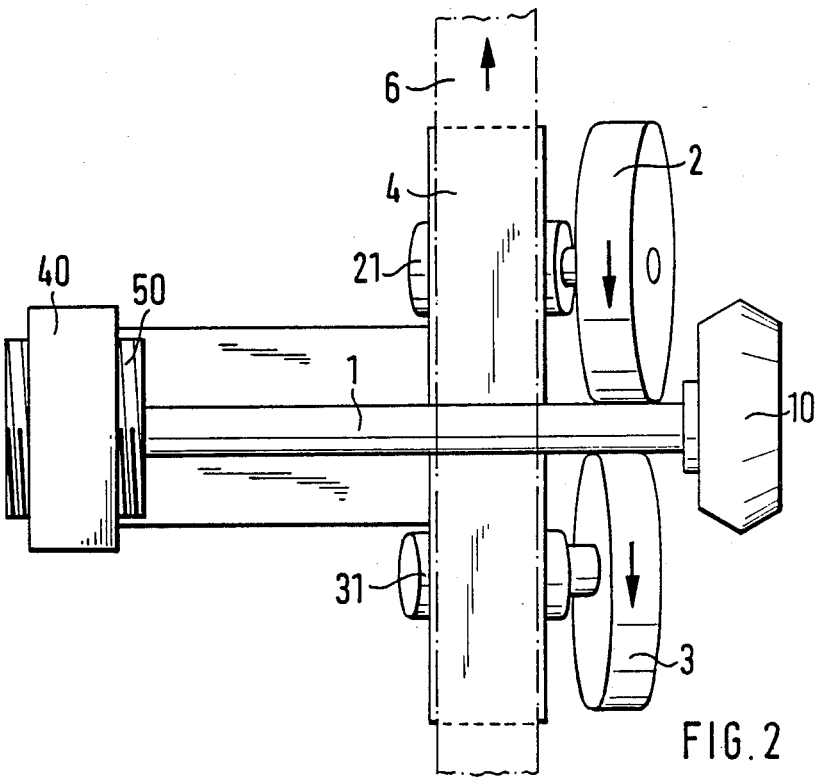
FIG. 2 shows the plan view of the device according to FIG. 1.
Figure 3:
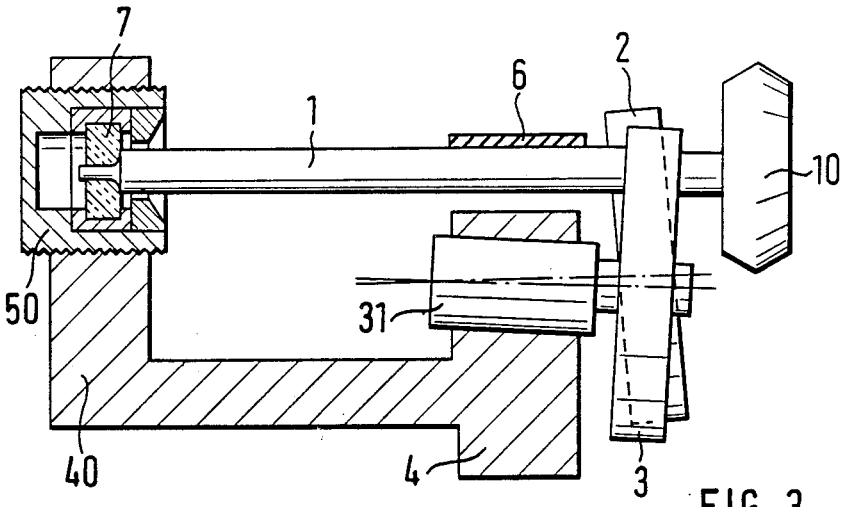
FIG. 3 shows, in a side view and partially in section, a modification of the device according to FIG. 1 with a plain bearing at the end of the rotor shaft.

Apart from this first bearing point formed by the supporting disks 2 and 3, the rotor shaft 1 is further mounted only at a second bearing point. In FIGS. 1 and 2, this second bearing point is a ball-bearing 5, without an inner race, which receives the free end 11 of the rotor shaft 1. To keep the diameter of the ball-bearing 5 as small as possible and to allow high speeds of rotation of the rotor shaft 1, the diameter of the free end 11 of the rotor shaft 1 is reduced. The ball-bearing 5, which is used for preference, but which does not exclude the use of other roller bearings, is capable of absorbing radial and axial forces. The latter are required for fixing the rotor shaft 1 and spinning rotor 10 axially and in FIG. 1 are generated by offsetting the axles 20 and 30 of the supporting disks 2 and 3.

The ball-bearing 5 is arranged in a bearing bush 50 provided with an external thread and is embedded in a ring 51 which is made of an elastic material and which has a vibration-damping effect. The bearing bush 50 is screwed into a support 40 which is fixed to the bearing block 4 or which is integrated into the latter. Thus, the bearing bush 50 together with the ball-bearing 5 is adjustable in the axial direction, so that the spinning rotor 10 can be positioned axially. On the side facing the spinning rotor 10, the bearing bush 50 is closed by means of a removable cover 52, in which there is a centering bore 53 of conical design for the rotor shaft 1. The conical part of the centering bore 53 has adjoining it a cylindrical part 41, the length of which is at least equal to the largest diameter of the rotor shaft 1. This design of the centering bore 53, which is located in front of the ball-bearing 5 and through which the rotor shaft 1 is guided, prevents the ball-bearing 5 from being damaged because of improper handling when the rotor shaft 1 is inserted into the latter. It also serves to prevent lubricant from escaping from the bearing.

The spinning rotor 10 is driven by means of a tangential belt 6 which is pressed against the shaft by means of a tensioning roller (not shown) over the front third of the unsupported length of the rotor shaft 1 and therefore in the vicinity of the supporting disks 2 and 3.

Figure 8:
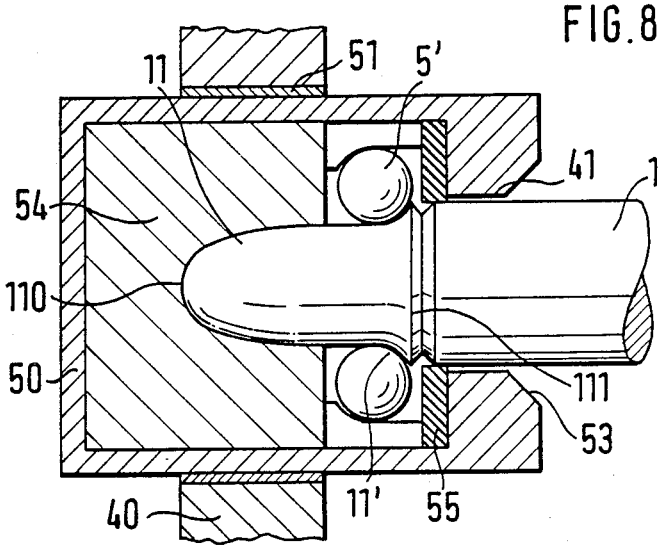
FIG. 8 shows a further embodiment with an inclined ball-bearing receiving the end of the rotor shaft.

The roller bearing used is preferably an inclined ball-bearing 5', the inner running surface 11' of which is an integral component of the rotor shaft 1 (FIG. 8). The diameter of the inner running surface 11' is 0.2 to 0.8 times the diameter of the rotor shaft 1. Whereas, in FIG. 1, the roller bearing is embedded in the bearing bush 50 in an elastic ring 51, here the bearing bush 50 is mounted elastically in the support 40 by means of the ring 51.

The free end 11 of the rotor shaft 1, this free end adjoining the inner running surface 11' directly, tapers towards its absolute end 110 and is designed in the form of a paraboloid. The ball running surfaces are lubricated by means of a lubricant reservoir 54 which is arranged in the bearing bush 50 and into which the tapering free end 11 of the rotor shaft 1, but at least its rounded absolute end 110, penetrates and is surrounded closely by the lubricant reservoir 54. The inclined surface of the free end 11 assists the supply of lubricant to the ball running surfaces.

To prevent lubricant from escaping fom the bearing bush 50, the through-orifice of the bearing bush 50 for the rotor shaft 1 is sealed off by a sealing ring 55. A rim 111 or even several rims which the rotor shaft 1 possesses in the region of the sealing ring 5 ensure that the lubricant is thrown back again into the lubricant reservoir 54.

In FIGS. 1 to 6, the reference symbols for the parts of the device which have already been described are retained. However, the exemplary embodiment according to FIG. 3 differs from those described above in that the bearing at the end of the rotor shaft 1 is a sliding bearing 7, for example one made of sintered ceramic, which is mounted elastically in the bearing bush 50 and absorbs axial and radial forces.

Figure 4:
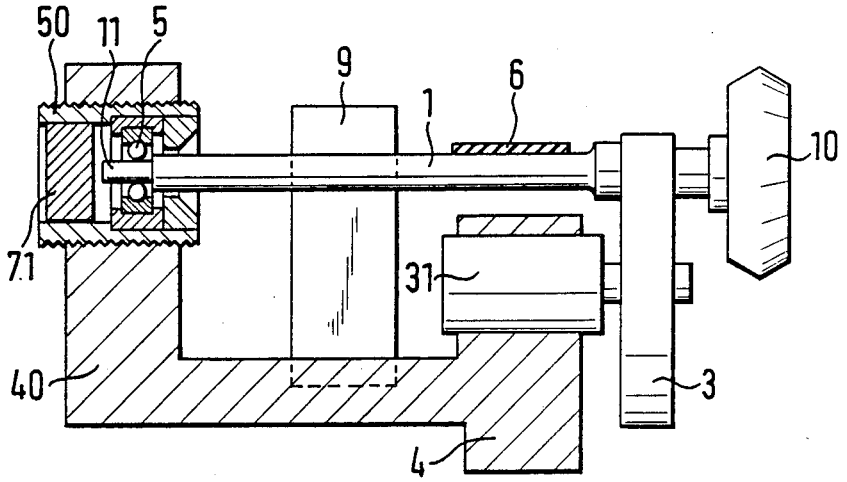
FIG. 4 shows a rotor mounting with a magnet acting on the end of the rotor shaft.

In FIG. 4, the axial thrust in the direction of the bearing receiving the free end of the rotor shaft 1 is generated not by offsetting of the axles of the supporting disks 2 and 3, but by a magnet 71 which is inserted into the bearing bush 50. The magnet 71 acts on the free end 11 of the rotor shaft 1 and generates the axial force necessary for securing the rotor shaft 1 axially. The rotor shaft 1 is of reduced diameter over its unsupported length, so that the spinning rotor 10 is driven at a higher speed without an increase in the running speed of the tangential belt. To achieve this, however, it is also sufficient to reduce the shaft diameter in the region of the drive means only. Arranged between the tangential belt 6 and the bearing bush 50 is a braking device for the rotor shaft 1, which is indicated at 9 and which is also described with reference to FIG. 7. Of course, the braking device can be used in all the embodiments.

Figure 5:
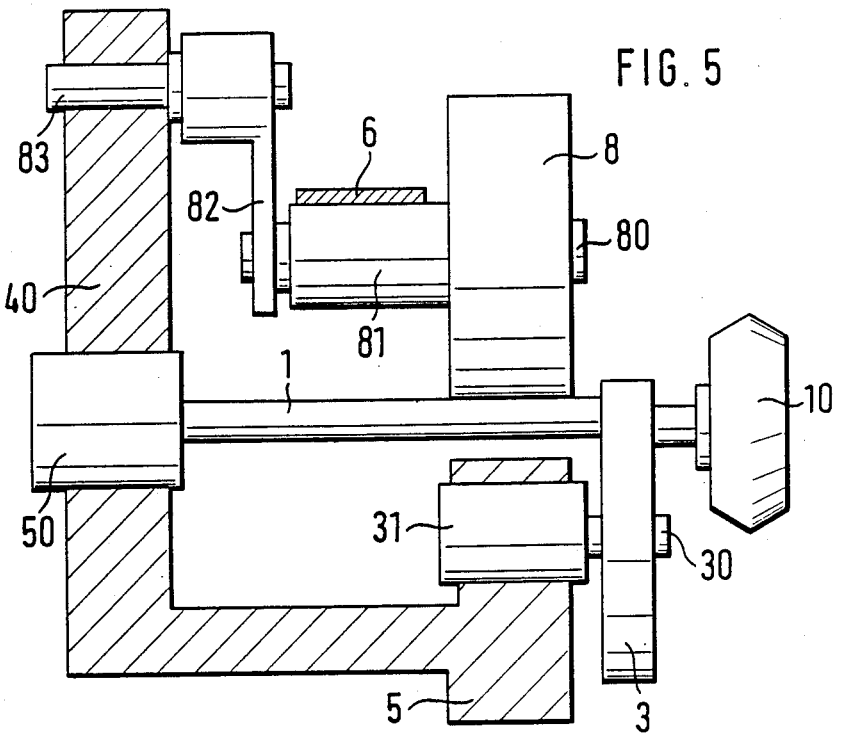
FIG. 5 shows, in a side view, a drive of the rotor shaft mounted according to the invention, by means of a friction roller with a tangential-belt drive.

In the embodiment illustrated in FIG. 5, the rotor shaft 1 is driven indirectly in the vicinity of the supporting-disk mounting by means of a friction roller 8 which is fixed to a sleeve 81 and which is mounted rotatably, together with this; on an axle 80 located on a pivoting lever 82. Here, the tangential belt 6 runs over the sleeve 81.

Figure 6:
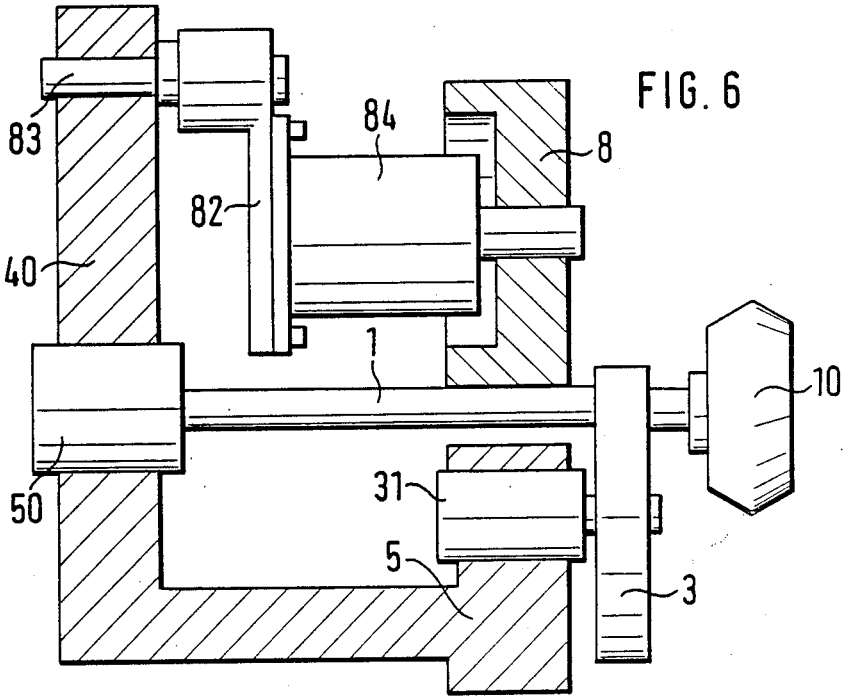
FIG. 6 shows, in a side view, the device according to FIG. 5, but with an electric motor driving the friction roller.

In FIG. 6, the rotor shaft 1 is likewise driven indirectly near the supporting disks by means of the friction roller 8. Here, however, the friction roller 8 rests fixedly in terms of rotation on the rotor axle of an electric motor 84 flanged to the pivoting lever 82 and is made to rotate by means of electric motor.

Figure 7:
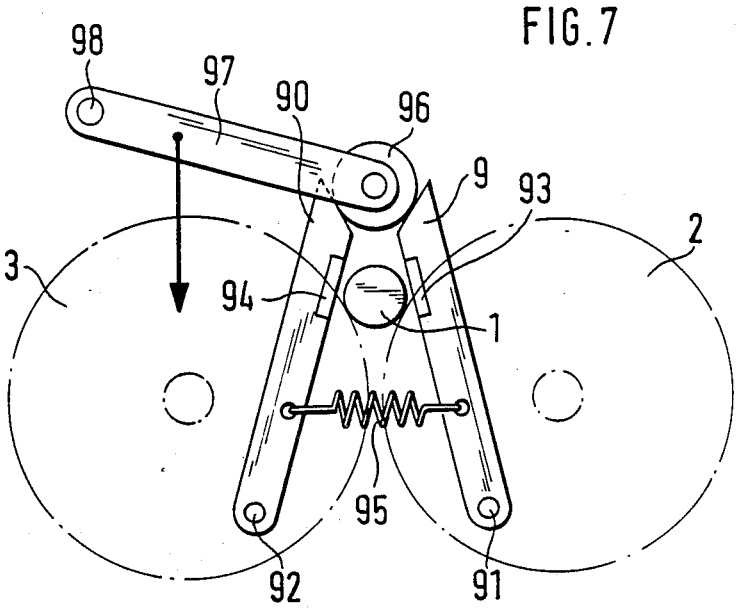
FIG. 7 shows a front view of braking means for the rotor shaft.

The braking device already mentioned with regard to FIG. 4 contains, according to FIG. 7, two pivoting arms 9 and 90 which are pivotable about fixed axles 91 and 92. Each of the two pivoting arms 9 and 90 carries a brake jaw 93 and 94 at the height of the rotor shaft 1. A tension spring 95 fixed to pivoting arms 9 and 90 brings the brake jaws 93 and 94 up against the rotor shaft 1. During running, this is prevented by a roller 96 which is arranged on an arm 97 pivotable about an axle 98 and which spreads the pivoting arms 9 and 90 apart from one another. When the roller 96 releases the pivoting arms, the brake jaws 93 and 94 are pressed against the rotor shaft 1 by means of the tension spring 95 and hold it secured radially in the mounting. As a result of this design and arrangement of the braking device, possible because the rotor shaft is mounted according to the invention, the bearings, especially also the plastic running surfaces of the supporting disks, are subjected to only a slight load when the spinning rotor is stopped, so that their service life is increased. However, the known stopping of the spinning rotor as a result of braking from above into the wedge-shaped gap between the supporting rollers is not excluded.

In the mounting according to the invention, the rotor shaft can be drawn out of the mounting, as before. Moreover, it is possible to exchange the supporting disks quickly during operation, since no obstacles prevent them from being removed from the bearing block. Furthermore, the mounting provides sufficient space to arrange and design the braking means for the rotor shaft in such a way that, when the spinning rotor is stopped, the bearings are subjected to as little load as possible.

We claim:

1. An open-end rotor-spinning device, comprising:

(a) a rotor shaft for supporting said rotor, having a free end portion;

(b) a pair of spaced discs, each of which is mounted for rotation about its own axis, and forming a wedge-shaped gap between adjacent surfaces of said discs for supporting said rotor shaft at a point adjacent to said rotor to restrain said rotor against radial displacement;

(c) axial radial thrust bearings for supporting the free end of said rotor shaft for rotation about its longitudinal axis, and for restraining said rotor shaft against both radial and axial displacement;

(d) a conical centering bore disposed between said axial radial thrust bearings an the rotor, and adapted to receive the free end of the rotor shaft; and (e) means to rotate said rotor shaft about its longitudinal axis.

2. An open-end rotor-spinning device as set forth in claim 1, wherein the free end of said rotor shaft is reduced in diameter.

3. An open-end rotor-spinning device as set forth in claim 1, wherein said axial radial thrust bearing is a roller bearing, which absorbs axial forces in the direction away form said rotor, but which permits the rotor shaft to move freely along its longitudinal axis in the direction of the rotor.

4. An open-end rotor-spinning device as claimed in claim 3 wherein the roller bearing is an inclined ball-bearing.

5. An open-end rotor-spinning device as set forth in claim 4 wherein the inner race of the roller bearing is an integral component of the rotor shaft.

6. An open-end rotor-spinning device as set forth in claim 5, wherein the diameter of said inner race is from 0.2 to 0.8 × the diameter of the rotor shaft.

7. An open-end rotor-spinning device as set forth in claim 1, wherein said axial radial thrust bearing is a sliding bearing.

8. An open-end rotor-spinning device as set forth in claim 1, wherein an axial thrust is generated on the rotor shaft by offsetting the longitudinal axis of the spaced discs.

9. An open-end rotor-spinning device as set forth in claim 1, wherein the axial force maintaining the rotor in an axial position is generated by a magnet active on said free end of said rotor shaft.

10. An open-end rotor-spinning device as set forth in claim 1, wherein the position of the axial radial thrust bearings is adjustable along the longitudinal axis of said rotor shaft.

11. An open-end rotor-spinning device as set forth in claim 1, wherein said axial radial thrust bearings are disposed in an adjustable bearing bush.

12. An open-end rotor-spinning device as set forth in claim 11, wherein said axial radial thrust bearing is resiliently mounted in the bearing bush.

13. An open-end rotor-spinning device as set forth in claim 11, wherein the bearing bush is resiliently mounted in a support.

14. An open-end rotor-spinning device as set forth in claim 1, wherein a cylindrical bore is disposed between the conical centering bore and said axial radial thrust bearings.

15. An open-end rotor-spinning device as set forth in claim 14, wherein the diameter of the cylindrical bore is at least equal to the largest diameter of the rotor shaft.

16. An open-end rotor-spinning device as set forth in claim 1, wherein the means for rotating said rotor shaft about its logitudinal axis contacts said rotor shaft near the point said shaft is supported by said pair of discs.

17. An open-end rotor-spinning device as set forth in claim 16 wherein said rotor shaft is rotated by direct contact with a tangential driving belt.

18. An open-end rotor-spinning device as set forth in claim 16 wherein said rotor shaft is rotated by direct contact with a friction roller.

19. An open-end rotor-spinning device as set forth in claim 1, wherein a braking device for stopping the rotor is disposed between the drive means and the axial radial thrust bearings.

20. An open-end rotor-spinning device as set forth in claim 19 herein the braking device contains two pivoted arms, one each arranged on each side of the rotor shaft, said arms being provided with brake jaws for gripping said rotor shaft.

21. An open-end rotor-spinning device as set forth in claim 1, wherein the diameter of the rotor shaft is reduced at the point it is contacted by said means for rotating said rotor shaft.

22. An open-end rotor-spinning device, comprising:

(a) a rotor shaft for supporting said rotor, having a tapered free end portion;

(b) a pair of spaced discs, each of which is mounted for rotation about its own axis, and forming a wedge-shaped gap between adjacent surfaces of said discs for supporting said rotor shaft at a point adjacent to said rotor to restrain said rotor against radial displacement;

(c) axial radial thrust ball bearings for supporting the free end of said rotor shaft for rotation about its longitudinal axis, for restraining said rotor against radial displacement and against axial displacement in the direction away from said rotor, said ball bearings having a inclined inner race to receive the tapered end of said rotor; and (d) means to rotate said rotor shaft about its longitudinal axis.

23. An open-end rotor-spinning device as set forth in claim 22, wherein the tapered end is in the form of a paraboloid.

24. An open-end rotor-spinning device as set forth in claim 22, wherein said free end of said rotor shaft is rounded.

25. An open-end rotor-spinning device, comprising:

(a) a rotor shaft for supporting said rotor, having a free end portion;

(b) a pair of spaced discs, each of which is mounted for rotation about its own axis, and forming a wedge-shaped gap between adjacent surfaces of said discs for supporting said rotor shaft at a point adjacent to said rotor to restrain said rotor against radial displacement;

(c) axial radial thrust bearings disposed in an adjustable bearing bush having a lubricant reservoir therein, for supporting and lubricating said free end of said rotor shaft for rotation about its longitudinal axis, and for restraining said rotor shaft against both radial and axial displacement; and (d) means to rotate said rotor shaft about its longitudinal axis.

26. An open-end rotor-spinning device as set forth in claim 25, wherein the end of the rotor shaft extends into the lubricant reservoir.

27. An open-end rotor-spinning device as set forth in claim 25, wherein the lubricant reservoir closely surrounds the end of the rotor shaft.

28. An open-end rotor-spinning device as set forth in claim 25, wherein a sealing ring closes the bearing bush about the rotor shaft.

29. An open-end rotor-spinning device as set forth in claim 28, wherein said rotor shaft has, in the region of the sealing ring, at least one rim which throws off lubricant.

* * * * *